US008066542B2

(12) United States Patent
Ejima

(10) Patent No.: US 8,066,542 B2
(45) Date of Patent: Nov. 29, 2011

(54) TRANSFORMABLE TOY

(75) Inventor: Takio Ejima, Tokyo (JP)

(73) Assignee: Tomy Company, Ltd., Tokyo (JP)

( * ) Notice: Subject to any disclaimer, the term of this patent is extended or adjusted under 35 U.S.C. 154(b) by 109 days.

(21) Appl. No.: 12/379,117

(22) Filed: Feb. 12, 2009

(65) Prior Publication Data

US 2009/0209167 A1 Aug. 20, 2009

(30) Foreign Application Priority Data

Feb. 14, 2008 (JP) ..... 2008-032550

(51) Int. Cl.
*A63H 17/00* (2006.01)
*A63H 3/46* (2006.01)

(52) U.S. Cl. ..... 446/93; 446/95; 446/99; 446/376; 446/487

(58) Field of Classification Search ..... 446/97, 446/99, 321, 376, 487, 93–95, 320
See application file for complete search history.

(56) References Cited

U.S. PATENT DOCUMENTS

| | | | | |
|---|---|---|---|---|
| 4,170,840 | A | 10/1979 | Ogawa | |
| 4,206,564 | A | 6/1980 | Ogawa | |
| 4,214,402 | A | 7/1980 | Ogawa | |
| 4,302,903 | A | 12/1981 | Pun | |
| 4,391,060 | A | 7/1983 | Nakane | |
| 4,516,948 | A | 5/1985 | Obara | |
| D279,307 | S * | 6/1985 | Murakami | D21/581 |
| 4,543,073 | A * | 9/1985 | Matsuda | 446/230 |
| 4,545,451 | A | 10/1985 | Pipa et al. | |
| 4,571,201 | A | 2/1986 | Matsuda | |
| 4,571,203 | A | 2/1986 | Murakami | |
| 4,575,352 | A | 3/1986 | Matsuda | |
| 4,578,046 | A * | 3/1986 | Ohno | 446/376 |
| 4,580,993 | A * | 4/1986 | Ohno | 446/376 |
| 4,583,958 | A | 4/1986 | Matsuda | |
| 4,586,911 | A * | 5/1986 | Murakami | 446/376 |
| 4,599,078 | A * | 7/1986 | Obara | 446/95 |

(Continued)

FOREIGN PATENT DOCUMENTS

GB 25254 11/1911

(Continued)

OTHER PUBLICATIONS

Patent Abstracts of Japan, Publication No. 9-10442, Published Jan. 14, 1997.

(Continued)

*Primary Examiner* — Gene Kim
*Assistant Examiner* — Scott Young
(74) *Attorney, Agent, or Firm* — Staas & Halsey LLP

(57) ABSTRACT

A transformable toy which can be automatically transformed despite the fact that members are merely pivotably connected as in conventional transformable toys is provided. The transformable toy, which is transformed from a box-like configuration to a robot configuration, is vertically and longitudinally divided into two parts, when in the box-like configuration, includes an upper front member, an upper rear member, a lower front member, and a lower rear member, and has a frame disposed therein for supporting the above members. The upper front member and the upper rear member are each pivotably connected to the frame directly, or through a link, and are foldably connected with each other. The connecting portion between the frame and the upper rear member has an elastic member for urging the upper front member and the upper rear member in a direction to be folded.

8 Claims, 7 Drawing Sheets

U.S. PATENT DOCUMENTS

| | | | | | |
|---|---|---|---|---|---|
| 4,605,383 | A | * | 8/1986 | Horiuchi | 446/376 |
| 4,623,317 | A | | 11/1986 | Nagano | |
| D287,258 | S | * | 12/1986 | Maruyama | D21/579 |
| 4,674,990 | A | * | 6/1987 | Ohno | 446/376 |
| 4,680,018 | A | * | 7/1987 | Ohno | 446/376 |
| D291,461 | S | * | 8/1987 | Kitamura | D21/582 |
| D292,109 | S | | 9/1987 | Lim | |
| D293,805 | S | * | 1/1988 | Matsumoto | D21/582 |
| 4,750,895 | A | | 6/1988 | Shinohara et al. | |
| 5,310,378 | A | * | 5/1994 | Shannon | 446/268 |
| 7,785,168 | B2 | * | 8/2010 | Yamada et al. | 446/376 |
| 2009/0209167 | A1 | | 8/2009 | Ejima | |
| 2009/0209168 | A1 | * | 8/2009 | Ejima | 446/93 |
| 2009/0233519 | A1 | * | 9/2009 | Ejima | 446/376 |

FOREIGN PATENT DOCUMENTS

| | | |
|---|---|---|
| GB | 2151149 | 7/1985 |
| JP | 9-10442 | 1/1997 |
| JP | 9-28933 | 2/1997 |
| JP | 3068216 | 2/2000 |
| JP | 3913746 | 5/2007 |
| WO | 99/07619 | 2/1999 |

OTHER PUBLICATIONS

Patent Abstracts of Japan, Publication No. 9-28933, Published Feb. 4, 1997.

Jun. 17, 2011 Notice of Allowance Office Action in U.S. Appl. No. 12/379,118.

Mar. 18, 2011 Notice of Allowance Office Action in U.S. Appl. No. 12/379,118.

Feb. 3, 2011 Office Action in U.S. Appl. No. 12/382,478.

Feb. 2, 2011 Office Action in U.S. Appl. No. 12/382,121.

European Search Report in Application No. 09250732.6.

Abstract Publication No. 3068216, Published Apr. 28, 2000.

Abstract Publication No. 3913746, Published May 9, 2007.

U.S. Appl. No. 12/379,118, filed Feb. 12, 2009, Takio Ejima, Assignee Tomy Company, Ltd.

U.S. Appl. No. 12/382,478 (now abandoned), filed Mar. 17, 2009, Takio Ejima, Assignee Tomy Company, Ltd.

U.S. Appl. No. 12/382,121, filed Mar. 9, 2009, Shogo Hasui, Assignee Tomy Company, Ltd.

* cited by examiner

TRANSFORMABLE TOY

BACKGROUND OF THE INVENTION

1. Field of the Invention

The present invention relates to a transformable toy which is reversibly transformed between two configurations, from a first configuration such as a vehicle or an animal to a second configuration, or vice versa, and more particularly to a transformable toy which can be automatically transformed by using an elastic force of an elastic member.

2. Description of the Related Art

Conventionally, when a transformable toy is transformed during play, it has been required that each constituent part be manually operated and operating procedures have been complicated. Therefore, a transformable toy which can be transformed by a simple operation has been proposed (see, for example, Japanese Patent Application Laid-Open Publication No. 9-10442). In this transformable toy, a first configuration is a vehicle configuration, a second configuration is a robot configuration, and a rear member is provided with a sliding member in a forwardly and backwardly slidable manner, the sliding member being formed with a rack, being partly exposed above the rear member, and having an operating element mounted thereon. When the sliding member is slid forwardly by operation of the operating element, the rack formed on the sliding member slides forwardly. A gear formed at an end portion of one of two connecting links is in mesh with the rack, and the connecting links pivot about respective pivoting shafts and are thus folded. A front member is pivotably connected to the other of the connecting links, and since the front member is foldably connected to the rear member, the front member is folded with respect to the rear member, and the front member and the rear member constitute a trunk portion in the robot configuration, the trunk portion being part of a second configuration.

In the above-described transformable toy, the sliding member is formed with a rack, one of the connecting links is provided with a gear meshing with the rack, and the connecting links are driven by a sliding operation of the sliding member. Accordingly, the above-described transformable toy inevitably requires a gear, which has not been present in conventional transformable toys, and has problems that a gear is exposed and deteriorates the appearance of the toy and that manufacturing and assembly costs increase as the number of transforming regions increases, because the number of gears to be meshed also increases.

SUMMARY OF THE INVENTION

The present invention has been made in order to solve the above problems. An object of the present invention is to provide a transformable toy, based on a new idea, which can be automatically transformed without the use of a gear despite its appearance and in which main members are merely pivotably connected as in conventional transformable toys.

In order to solve the foregoing problems, according to the present invention, there is provided a transformable toy reversibly transformed from a first configuration to a second configuration. The first configuration of the transformable toy is a box-like configuration, the second configuration thereof is a robot configuration, and the transformable toy is vertically divided into two parts and longitudinally divided into two parts in the box-like configuration. The transformable toy includes an upper front member, an upper rear member, a lower front member, and a lower rear member; a frame disposed inside the transformable toy, the frame supporting the upper front member, the upper rear member, the lower front member, and the lower rear member, the upper front member and the upper rear member each being pivotably connected to the frame directly, or through a link, the upper front member and the upper rear member being foldably connected; and a first elastic member provided at a connecting portion between the frame and the upper front member or the upper, rear member, the first elastic member urging the upper front member or the upper rear member in a direction to fold the upper front member and the upper rear member, the lower front member including a pair of first elements, the first elements being pivotably connected to both sides of a front portion of the frame, respectively, the lower rear member including a pair of second elements, the second elements being pivotably connected to both sides of a rear portion of the frame, respectively, the lower rear member having an engaging portion for engaging with the upper rear member during pivoting of the upper rear member, the second elements of the lower rear member each being pivoted outwardly during engagement of the engaging portion with the upper rear member. The transformable toy is transformed from the first configuration to the second configuration by using an elastic force of the first elastic member.

Preferably, when the upper front member and the upper rear member are folded, the upper front member constitutes a chest portion of a robot, the upper rear member constitutes a back portion of the robot, and the second elements of the lower rear member which have been pivoted outwardly constitute arm portions of the robot.

The transformable toy may include a second elastic member provided at a connecting portion between each second element of the lower rear member and the frame, the second elastic member acting against the elastic force of the first elastic member, the second elastic member preferably having an elastic force set to be smaller than the elastic force of the first elastic member.

Moreover, preferably, the transformable toy includes a lock mechanism provided between the upper front member and the upper rear member, the lock mechanism preventing pivoting of the upper rear member against the elastic force of the first elastic member.

According to the present invention, it is possible to provide a transformable toy, based on a new idea, which can be automatically transformed and can give the user a surprise despite its appearance, and which is similar to conventional transformable toys since anything unrelated to a configuration, such as a gear, is invisible during transformation, because all main members are merely pivotably connected without a gear or the like therebetween.

According to one embodiment of the present invention, when the upper rear member is pivoted backwardly by an elastic force of the first elastic member, the upper front member and the lower rear member pivot in linkage with the upper rear member, allowing the transformable toy to be instantly transformed into a robot configuration.

According to one embodiment of the present invention, when the transformable toy is transformed from a first configuration to a second configuration by the elastic force of the first elastic member, the elastic force of the second elastic member is canceled out. However, when the upper rear member is returned to its original position against the elastic force of the first elastic member, by using an external force, the elastic force of the second elastic member is exerted and the lower rear member pivots inwardly, allowing the transformable toy to be easily restored to the first configuration.

DESCRIPTION OF THE EMBODIMENTS

Figure 1:
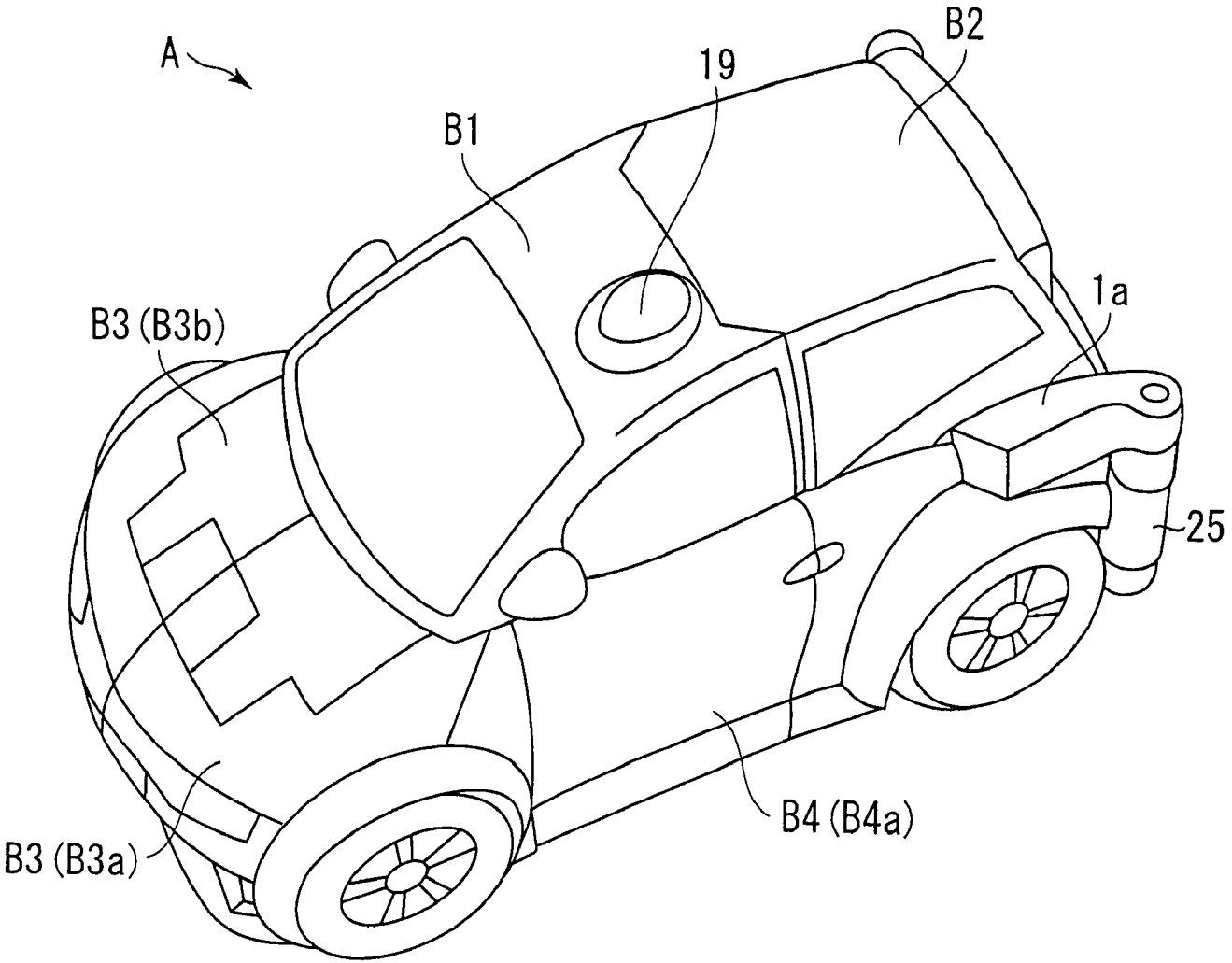
FIG. 1 is a perspective view showing a first configuration of a transformable toy of the present invention.
Figure 2:
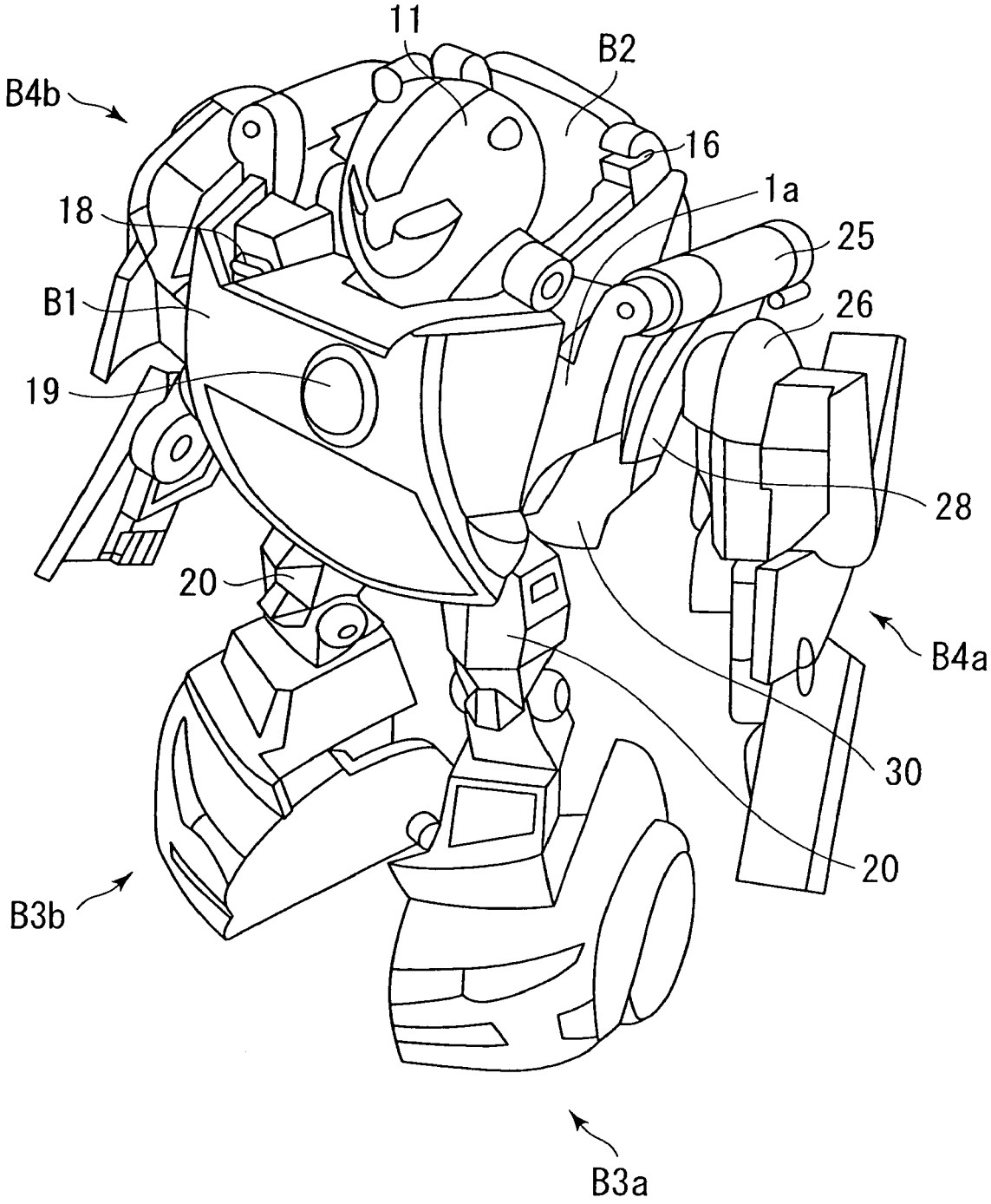
FIG. 2 is a perspective view showing a state of the transformable toy which has been transformed into a second configuration.

FIG. 1 shows one example of a first configuration of a transformable toy A according to the present invention, in which the first configuration is a box-like configuration, the box-like configuration being, in the present invention, constructed to simulate a running object, i.e., a vehicle and the transformable toy can be transformed into, e.g., a robot configuration, as shown in FIG. 2, when transformation into a second configuration is carried out.

In the first configuration, the transformable toy A is vertically divided into two parts and longitudinally divided into two parts and includes four members: an upper front member B1, which constitutes a roof corresponding to front seats; an upper rear member B2, which constitutes a roof corresponding to rear seats; a lower front member B3, which constitutes a hood; and a lower rear member B4, which constitutes door panels. The lower front member B3 is transversely divided into two parts and includes a left hood portion B3*a* and a right hood portion B3*b*, which are a pair of first elements. The lower rear member B4 includes a left door panel portion B4*a* and a right door panel portion B4*b*, which are a pair of second elements.

Moreover, the transformable toy A has a frame 1 disposed therein, to which the above four members B1 to B4 are each pivotably connected.

Figure 3:
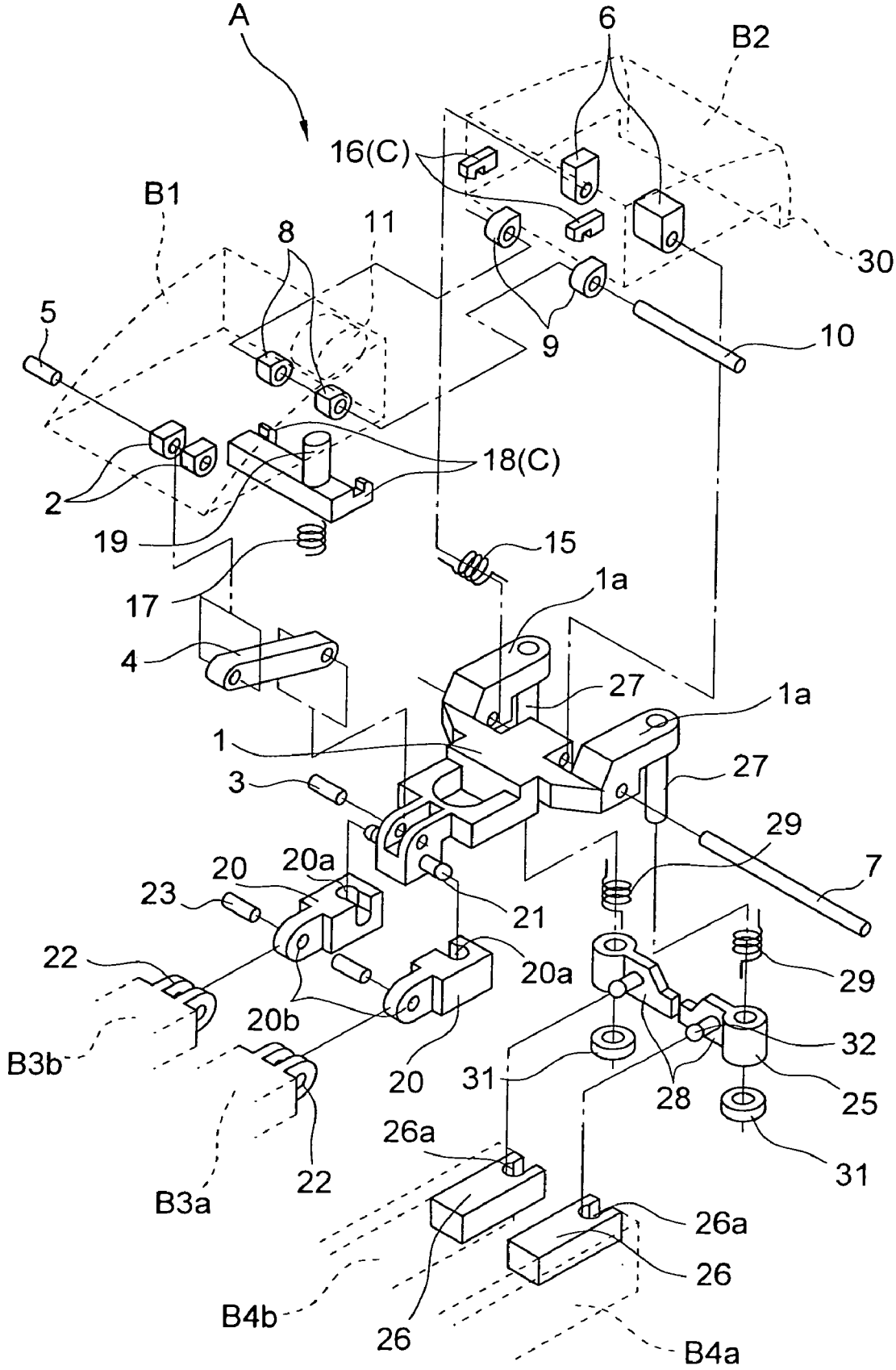
FIG. 3 is an exploded perspective view showing a construction of basic portions of the transformable toy.

FIG. 3 is an exploded perspective view showing a construction of basic portions of the above transformable toy A. The upper front member B1 has bearings 2 provided on a lower surface thereof, which are connected through a shaft 5 to an end of a link 4, which is pivotably connected through a shaft 3 to a front portion of a frame 1. The upper rear member B2 has bearings 6 provided on a lower surface thereof, which are connected through a shaft 7 to a rear portion of the frame 1 in a forwardly and backwardly pivotable manner. Bearings 8, provided at a lower portion of a rear end of the upper front member B1, and bearings 9, provided at a lower portion of a front end of the upper rear member B2, are connected through a shaft 10. The upper front member B1 and the upper rear member B2 are constructed to be foldable on the shaft 10 used as the supporting point. When the upper front member B1 and the upper rear member B2 are folded, a head portion 11 of a robot mounted on a rear surface of the upper front member B1 is exposed.

A spring 15, which is a first elastic member, is mounted at a connecting portion between the upper rear member B2 and the frame 1, and the upper rear member B2 is urged by an elastic force of the spring 15 to pivot backwardly about the shaft 7.

Moreover, between the upper front member B1 and the upper rear member B2, there is provided a lock mechanism C for preventing the pivoting of the upper rear member B2 against the elastic force of the spring 15. The lock mechanism C includes first hooks 16, each having a recessed engaging portion, which are formed to protrude from a front portion of the upper rear member B2 into the upper front member B1; and second hooks 18, each having a protruding engaging portion, which are disposed inside the upper front member B1 in a vertically movable manner and urged upwardly by a spring 17. An operating button 19 is formed to protrude upwardly on an upper surface of the second hooks 18. The operating button 19 is urged by the spring 17 to protrude upwardly from an upper surface of the upper front member B1, so that the operating button 19 can be pressed from above.

The left hood portion B3*a* and the right hood portion B3*b* are connected to the frame 1 through joint members 20, respectively. Mating recesses 20*a* formed in inside surfaces of the joint members 20 fit pivotably and loosely with joint shafts 21, which are formed to protrude laterally from both side portions of a front portion of the frame 1, respectively. Bearings 20*b* formed at front ends of the joint members 20 and bearings 22 formed at ends of the left hood portion B3*a* and the right hood portion B3*b* are pivotably connected by a shaft 23, respectively.

Meanwhile, the left door panel portion B4*a* and the right door panel portion B4*b* are connected through joint members 26, respectively, to pivoting members 25, which are pivotably mounted on supporting shafts 27 protruding downwardly from arms 1*a*, which project backwardly from the frame 1. The pivoting members 25 are formed with projecting lugs 28, which are engaging portions, and are urged by springs (second elastic members) 29 so that the projecting lugs 28 pivot in a direction to abut on an engaging plate 30 formed to project downwardly from a rear end of the upper rear member B2. The springs 29 have an elastic force set to be smaller than the elastic force of the spring 15.

The pivoting members 25 are prevented by rings 31 fixed to lower ends of the supporting shafts 27 from disengaging from the supporting shafts 27. The projecting lugs 28 of the pivoting members 25 have joint shafts 32 formed to protrude on front surfaces thereof. Since mating recesses 26*a* formed in the joint members 26 are fitted loosely with ends of the joint shafts 32, the left door panel portion B4*a* and the right door panel portion B4*b* are freely orientable with respect to the pivoting members 25, respectively.

Figure 4A:
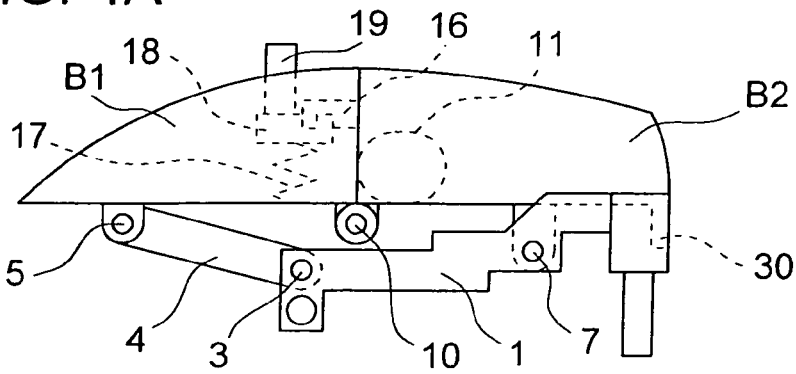
FIGS. 4A to 4D are explanatory diagrams showing a process of transformation from the first configuration to the second configuration.
Figure 4B:
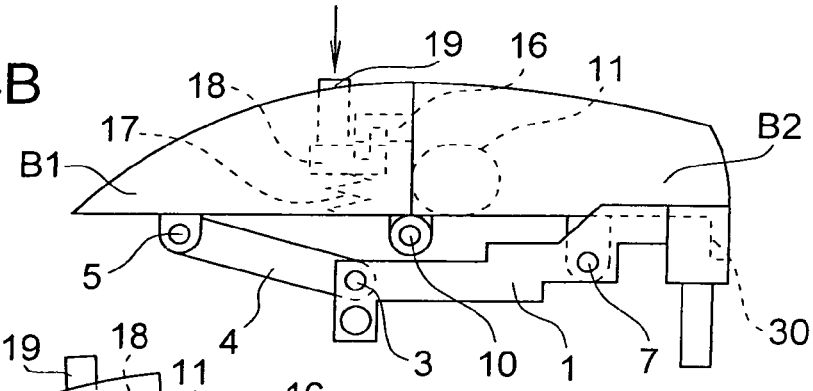

A process of transforming the transformable toy A having the above construction will be described on the basis of FIGS. 4A to 4D. The transformation of FIGS. 4A to 4D describes a state in which the upper front member B1 and the upper rear member B2 are folded. In the running-object configuration shown in FIG. 4A, when the operating button 19 protruding from the upper surface of the upper front member B1 is pressed down, the protruding engaging portions of the second hooks 18 disengage from the recessed engaging portions of the first hooks 16 and the locked state is released, as shown in FIG. 4B. Therefore, the upper rear member B2 is urged by the spring 15 to pivot about the shaft 7 backwardly with respect to the frame 1.

Since the upper front member B1 and the upper rear member B2 are pivotably connected through the shaft 10, the upper front member B1 is pulled backwardly. However, since the upper front member B1 is connected to an end of the frame 1 through the link 4, the upper front member B1 moves backwardly while remaining substantially parallel to the frame 1 (see FIG. 4C). Since the upper rear member B2 is urged by the spring 15, the upper rear member B2 pivots until a lower end of the engaging plate 30 abuts on a bottom surface of the frame 1. At this time, since the upper front member B1 is connected at a rear end thereof to the upper rear member B2 by the shaft 10 and is connected at a front portion thereof to the frame 1 by the link 4, the upper front member B1 moves so as to overlie an upper surface of the frame 1, and the upper front member B1 and the upper rear member B2 are folded on the shaft 10 used as the supporting point. As a result, the upper front member B1 constitutes a chest portion and the upper rear member B2 constitutes a back portion in the robot configuration, and the head portion 11 of the robot provided on the upper front member B1 is exposed (see FIGS. 4D and 5).

Figure 6A:
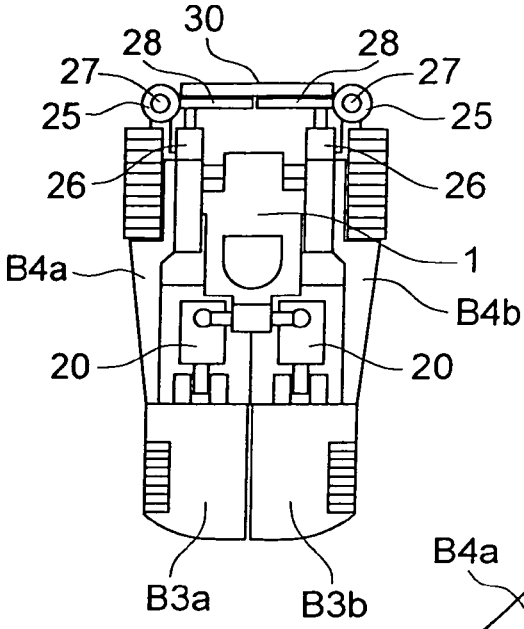
FIGS. 6A to 6C are explanatory diagrams showing a process of transformation from the first configuration to the second configuration.
Figure 6B:
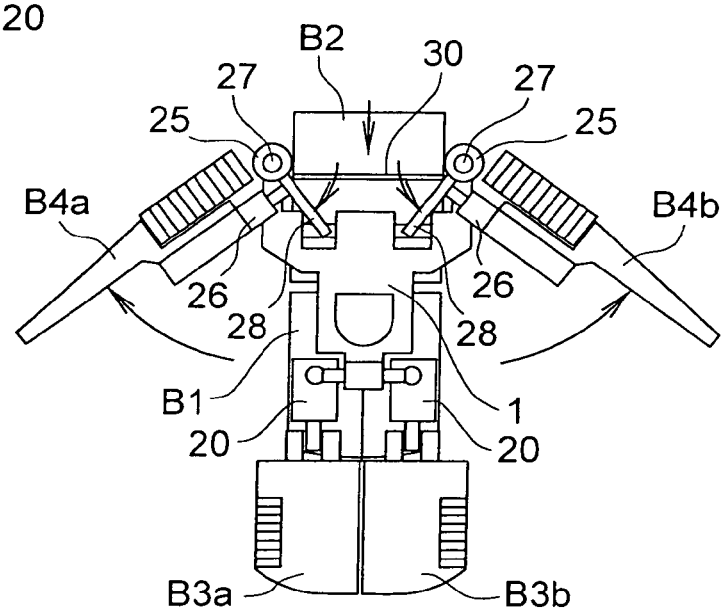
Figure 6C:
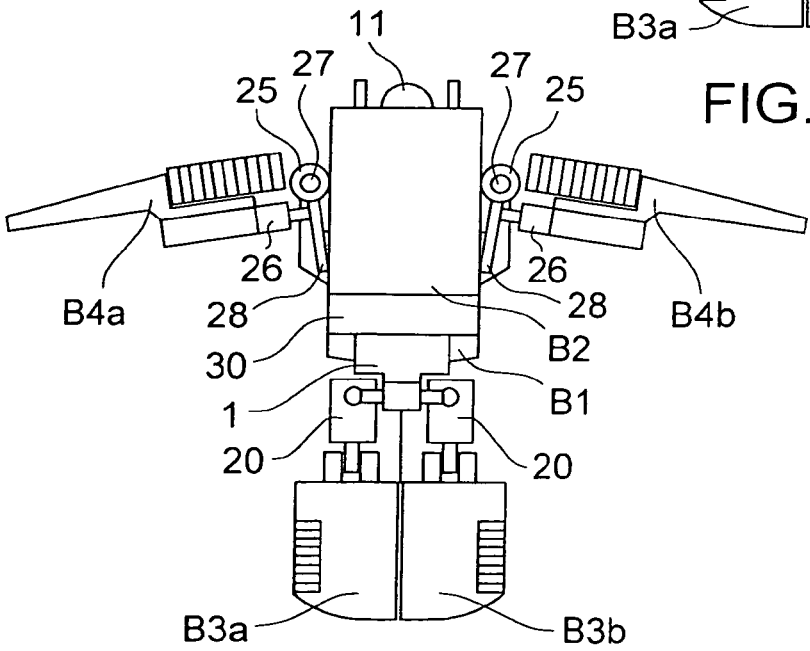

Next, a process in which the lower rear member B4 extends laterally as the upper rear member B2 pivots will be described on the basis of FIGS. 6A to 6C. FIG. 6A shows the transformable toy A in the state of FIG. 4A, as viewed from the bottom, in which the operating button 19 has not yet been pressed. In this state, the pivoting members 25 supported on the supporting shafts 27 are urged by springs 29 and the projecting lugs 28 are in abutment with the engaging plate 30. At this time, the left door panel B4*a* and the right door panel B4*b*, which are connected to the projecting lugs 28 through the joint members 26, pivot inwardly and each constitute a door panel, as shown in FIG. 1, in the running-object configuration.

Figure 4C:
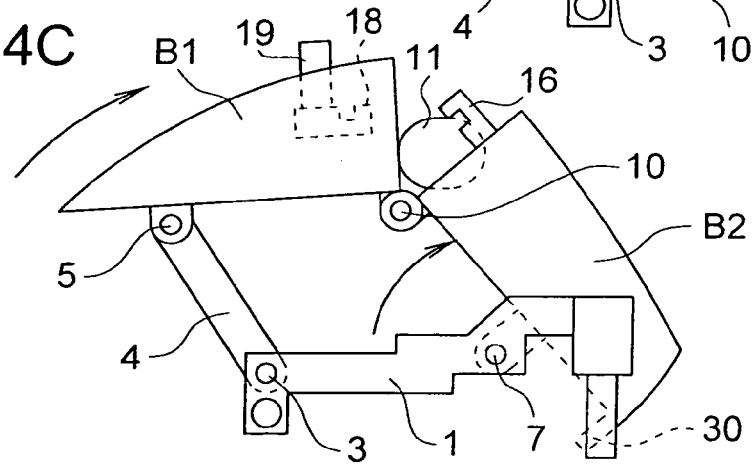
Figure 4D:
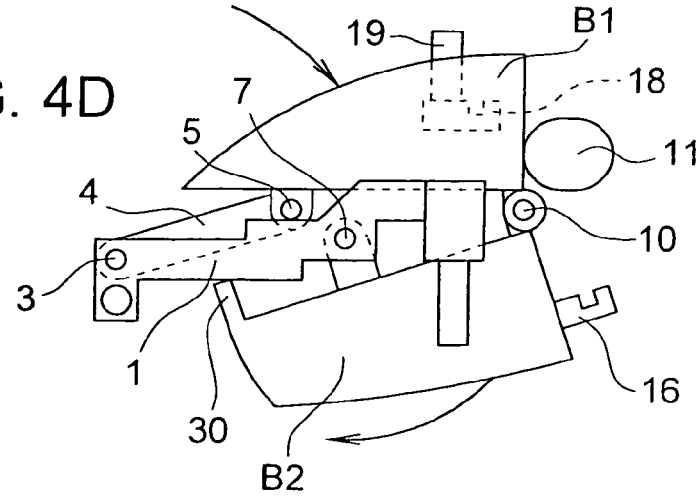
Figure 5:
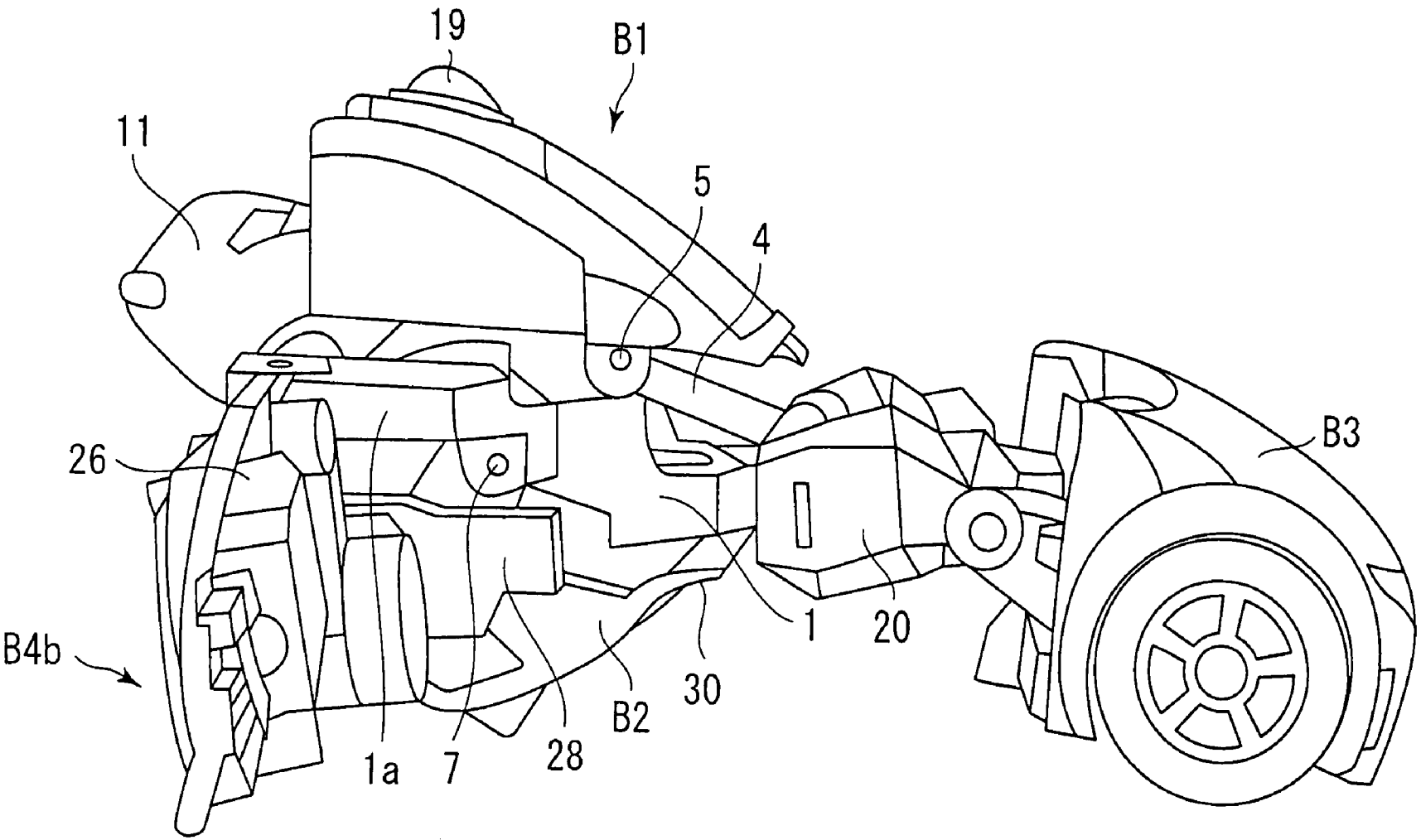
FIG. 5 is a side view showing a state of the transformable toy which has been transformed into the second configuration.

When the operating button 19 is pressed down and the lock is released, the upper rear member B2 is urged by the spring 15 and begins to pivot about the shaft 7 backwardly with respect to the frame 1, and therefore the engaging plate 30 moves to a position under the frame 1, as shown in FIG. 4C.

Since the projecting lugs 28 provided on the pivoting members 25 are urged by the springs 29 and are in abutment with the engaging plate 30, when the projecting lugs 28 are pressed by the engaging plate 30, the pivoting members 25 begin to pivot outwardly about the supporting shafts 27. As a result, the left door panel portion B4*a* and the right door panel portion B4*b* mounted on the projecting lugs 28 through the joint members 26 are pivoted outwardly about the supporting shafts 27, respectively (see FIG. 6B).

When the upper rear member B2 has pivoted until the lower end of the engaging plate 30 abuts on the lower surface of the frame 1 (see FIG. 4D), the projecting lugs 28 are pressed further by side surfaces of the upper rear member B2 instead of the engaging plate 30. Therefore, the pivoting members 25 pivot further outwardly about the supporting shafts 27, and the left door panel portion B4*a* and the right door panel portion B4*b* pivot until they are substantially perpendicular to the side surfaces of the upper rear member B2 (see FIG. 6C).

Figure 7:
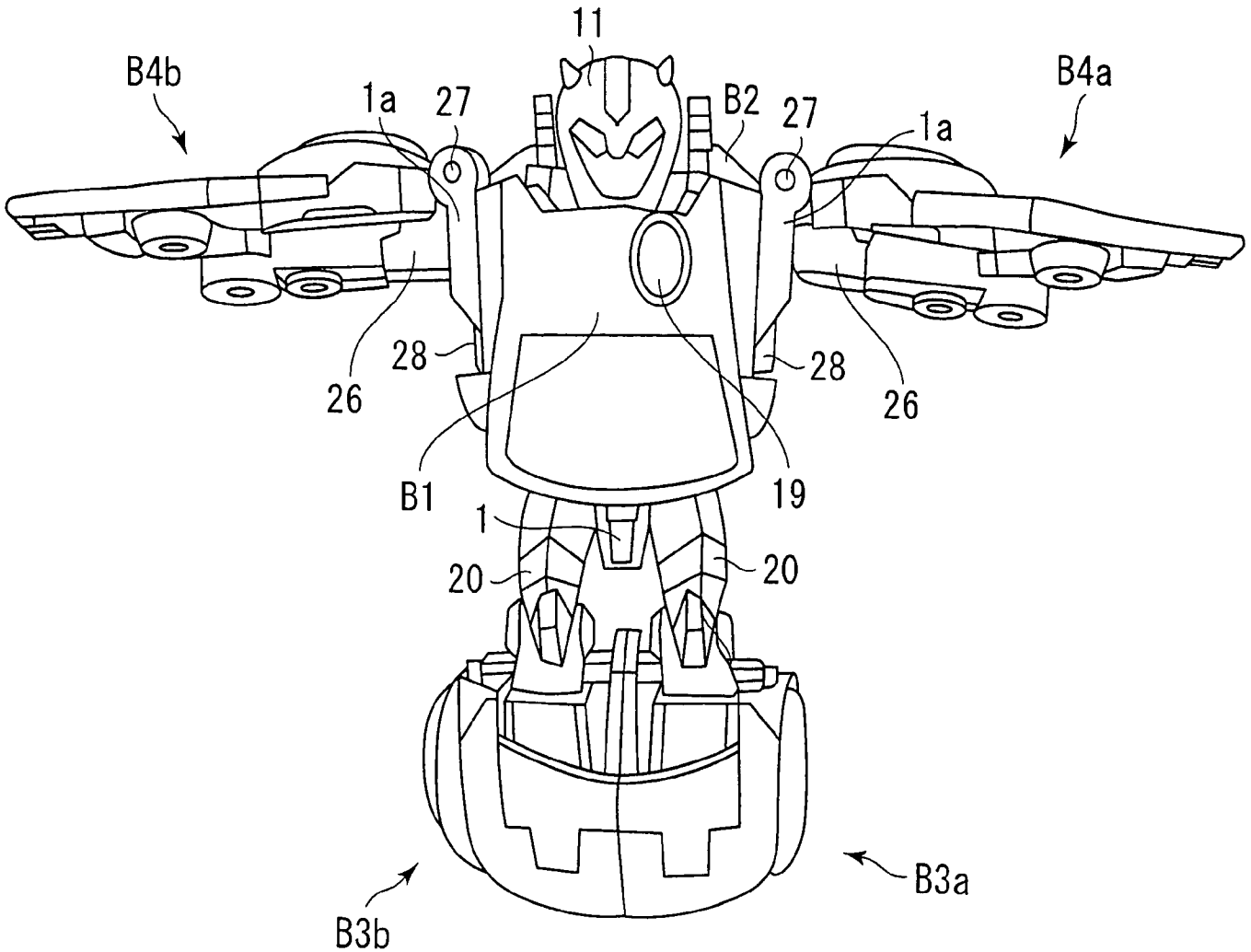
FIG. 7 is a front view showing a state of the transformable toy which has been transformed into the second configuration.

In this state, as shown in FIG. 7, the head portion 11 is exposed above the upper front member B1, and the left door panel portion B4*a* and the right door panel portion B4*b* are in a substantially horizontal state, whereby a robot with its arms stretched laterally is attained. Thus, the transformable toy has been transformed into a second configuration. In order to attain a robot configuration closer to a perfect robot, the joint members 26 may be pivoted downwardly with respect to the projecting lugs 28 so that the left door panel portion B4*a* and the right door panel portion B4*b* are oriented downwardly, whereby a robot with its arms lowered is attained, and the left hood portion B3*a* and the right hood portion B3*b* may be pivoted forwardly with respect to the joint members 20 so as to constitute feet in the robot configuration. By doing so, the transformable toy can be transformed into a robot, which is a second configuration, as shown in FIG. 2.

Meanwhile, in order to restore the transformable toy from the robot configuration to the running-object configuration, the lower rear member B4 (the left door panel portion B4*a* and the right door panel portion B4*b*), which constituted arms, may be restored to a horizontal state, the lower front member B3 (the left hood portion B3*a* and the right hood portion B3*b*), which constituted feet, may be pivoted backwardly so that the state as shown in FIG. 7 is attained, and then the upper rear member B2 may be forced to pivot upwardly against the force of the spring 15. By doing so, the recessed engaging portions of the first hooks 16 and the protruding engaging portions of the second hooks 18 mesh with each other, thereby effecting the function of the lock mechanism C and locking the upper front member B1 and the upper rear member B2 with each other, and the upper front member B1 and the upper rear member B2, which constituted a chest portion and a back portion, constitute roofs of the running object. Then, the pressing of the pivoting members 25 by the engaging portion 30 of the upper rear member B2 is released, and therefore the pivoting members 25 are urged by the elastic force of the springs 29 to pivot inwardly about the supporting shafts 27. Thus, the lower rear member B4 (the left door panel portion B4*a* and the right door panel portion B4*b*), which constituted arm portions, can be automatically restored, without being manually operated, to the respective door panels of the running object. Thus, the transformable toy can be readily restored from the second configuration, which is a robot configuration, to the first configuration, which is a running-object configuration.

While, in the above-described transformable toy, the box-like configuration, which is a first configuration, has been described as a running object, the box-like configuration is not limited to a running-object configuration, but may be a structure such as a building, or a ship such as a tanker. In such cases, unlike the case of a running object, the transformable toy can be transformed into a large-scale robot image, and therefore the user can enjoy the impact of the object being unpredictably transformed into a robot.

What is claimed is:

1. A transformable toy reversibly transformed from a first configuration to a second configuration, the first configuration of the transformable toy being a box-like configuration, the second configuration thereof being a robot configuration, the transformable toy being vertically divided into two parts and longitudinally divided into two parts in the box-like configuration, the transformable toy comprising:

an upper front member, an upper rear member, a lower front member, and a lower rear member;

a frame disposed inside the transformable toy, the frame supporting the upper front member, the upper rear member, the lower front member, and the lower rear member, the upper front member and the upper rear member each being pivotably connected to the frame directly, or through a link, the upper front member and the upper rear member being foldably connected; and a first elastic member provided at a connecting portion between the frame and the upper front member or the upper rear member, the first elastic member urging the upper front member or the upper rear member in a direction to fold the upper front member and the upper rear member to oppose each other, the lower front member including a pair of first elements, the first elements being pivotably connected to both sides of a front portion of the frame, respectively, the lower rear member including a pair of second elements, the second elements being pivotably connected to both sides of a rear portion of the frame, respectively, the lower rear member having an engaging portion for engaging with the upper rear member during pivoting of the upper rear member, the second elements of the lower rear member each being pivoted outwardly by engagement of the engaging portion with the upper rear member, wherein the transformable toy is transformed from the first configuration to the second configuration by using an elastic force of the first elastic member; and a second elastic member provided at a connecting portion between each second element of the lower rear member and the frame, the second elastic member acting against the elastic force of said first elastic member, the second elastic member having an elastic force set to be smaller than the elastic force of said first elastic member.

2. The transformable toy according to claim 1, wherein, when the upper front member and the upper rear member are folded, the upper front member constitutes a chest portion of the robot configuration, the upper rear member constitutes a back portion of the robot configuration, and the second elements of the lower rear member which have been pivoted outwardly constitute arm portions of the robot configuration.

3. The transformable toy according to claim 2, further comprising:

a lock mechanism provided between the upper front member and the upper rear member, the lock mechanism preventing pivoting of the upper rear member against the elastic force of the first elastic member.

4. The transformable toy according to claim 1, further comprising:

a lock mechanism provided between the upper front member and the upper rear member, the lock mechanism preventing pivoting of the upper rear member against the elastic force of the first elastic member.

5. A transformable toy reversibly transformed from a first configuration to a second configuration, the first configuration being a box-like configuration, the second configuration being a robot configuration, the transformable toy being vertically divided into two parts and longitudinally divided into two parts in the box-like configuration, the transformable toy comprising:

an upper front member, an upper rear member, a lower front member, and a lower rear member;

a frame disposed inside the transformable toy, the frame supporting the upper front member, the upper rear member, the lower front member, and the lower rear member, the upper front member and the upper rear member each being pivotably connected to the frame directly, or through a link, the upper front member and the upper rear member being foldably connected;

a first elastic member provided at a connecting portion between the frame and the upper front member or the upper rear member, the first elastic member urging the upper front member or the upper rear member in a direction to fold the upper front member and the upper rear member, the lower front member including a pair of first elements, the first elements being pivotably connected to both sides of a front portion of the frame, respectively, the lower rear member including a pair of second elements, the second elements being pivotably connected to both sides of a rear portion of the frame, respectively, the lower rear member having an engaging portion for engaging with the upper rear member during pivoting of the upper rear member, the second elements of the lower rear member each being pivoted outwardly by engagement of the engaging portion with the upper rear member, wherein the transformable toy is transformed from the first configuration to the second configuration by using an elastic force of the first elastic member; and a second elastic member provided at a connecting portion between each second element of the lower rear member and the frame, the second elastic member acting against the elastic force of said first elastic member, the second elastic member having an elastic force set to be smaller than the elastic force of said first elastic member; and a second elastic member provided at a connecting portion between each second element of the lower rear member and the frame, the second elastic member acting against the elastic force of said first elastic member, the second elastic member having an elastic force set to be smaller than the elastic force of said first elastic member.

6. The transformable toy according to claim 5, wherein, when the upper front member and the upper rear member are folded, the upper front member constitutes a chest portion of the robot, the upper rear member constitutes a back portion of the robot configuration, and the second elements of the lower rear member which have been pivoted outwardly constitute arm portions of the robot configuration.

7. The transformable toy according to claim 5, further comprising:

a lock mechanism provided between the upper front member and the upper rear member, the lock mechanism preventing pivoting of the upper rear member against the elastic force of the first elastic member.

8. The transformable toy according to claim 6, further comprising:

a lock mechanism provided between the upper front member and the upper rear member, the lock mechanism preventing pivoting of the upper rear member against the elastic force of the first elastic member.

* * * * *

UNITED STATES PATENT AND TRADEMARK OFFICE

CERTIFICATE OF CORRECTION

PATENT NO. : 8,066,542 B2
APPLICATION NO. : 12/379117
DATED : November 29, 2011
INVENTOR(S) : Takio Ejima It is certified that error appears in the above-identified patent and that said Letters Patent is hereby corrected as shown below:

Claim 5, Col. 8, lines 17-23, please delete:

"and a second elastic member provided at a connecting portion between each second element of the lower rear member and the frame, the second elastic member acting against the elastic force of said first elastic member, the second elastic member having an elastic force set to be smaller than the elastic force of said first elastic member;"

Signed and Sealed this
Twenty-first Day of February, 2012

David J. Kappos

David J. Kappos
*Director of the United States Patent and Trademark Office*